US005673617A

United States Patent [19]

Linder

[11] Patent Number: 5,673,617

[45] Date of Patent: Oct. 7, 1997

[54] CALENDAR FOR FULL AND LIGHT CALENDERING

[75] Inventor: Heiko Linder, Rheinberg, Germany

[73] Assignee: Voith Sulzer Finishing GmbH, Krefeld, Germany

[21] Appl. No.: 652,662

[22] Filed: May 28, 1996

[30] Foreign Application Priority Data

Jun. 1, 1995 [DE] Germany ..... 195 20 109.4

[51] Int. Cl.[6] ..... D21G 1/00; B30B 3/04

[52] U.S. Cl. ..... 100/47; 100/163 A

[58] Field of Search ..... 100/47, 163 R, 100/163 A, 164, 165, 168–170

[56] References Cited

U.S. PATENT DOCUMENTS

| | | | |
|---|---|---|---|
| 3,369,483 | 2/1968 | Müller | 100/170 |
| 3,942,434 | 3/1976 | Wenzel et al. | 100/47 |
| 3,948,166 | 4/1976 | Wenzel | 100/163 R |
| 4,823,690 | 4/1989 | Stotz | 100/47 |
| 4,890,551 | 1/1990 | Dahl et al. | 100/47 |
| 4,924,772 | 5/1990 | Schlunke et al. | 100/47 |
| 5,038,678 | 8/1991 | Honkala et al. | 100/47 |
| 5,443,000 | 8/1995 | Wenzel | 100/163 A |

FOREIGN PATENT DOCUMENTS

| | | |
|---|---|---|
| 30 12 852 | 7/1983 | Germany . |
| 43 14 670 | 11/1994 | Germany . |

*Primary Examiner*—Stephen F. Gerrity
*Attorney, Agent, or Firm*—Darby & Darby

[57] ABSTRACT

A calender for full and light calendering has rollers disposed one above the other. At least the middle rollers are mounted on bearing blocks, which are supported by levers. The levers are pivotably mounted on respective support blocks. The levers can pivot between an upper stop and a lower stop. A lifting device for the lowest roller moves the lowest roller through a separation stroke between an operating position and a separation position. The lifting device also move the lowest roller through an overstroke between the operating position, through a relief position in which the support blocks are spaced from their respective support elements, into an overstroke position, in which the support blocks of some of the uppermost rollers are lifted to an inactive position to permit the calender to be used for light calendering.

11 Claims, 5 Drawing Sheets

CALENDAR FOR FULL AND LIGHT CALENDERING

BACKGROUND OF THE INVENTION

1. Field of the Invention

The present invention relates to a calender capable of performing both full and light calendering.

2. Discussion of the Related Art

In "full calendering", all of the calender rollers are disposed in contact, one on top of the other. Additionally, a compressive force is applied to the rollers. In "light calendering", also known as "matte calendering", the calendering is performed without an additionally applied load. That is, no compressive force is applied to the rollers. Hence, the web of material passing through the calender is treated only due to the influence of the weight of the rollers themselves. Additionally, during light calendering, some of the upper rollers may not be used to treat the web. Therefore, the weight of the rollers that are not being used to treat the web must be supported so that their weight is not applied to the rollers that are being used.

German reference DE 30 12 852 C2 discloses a calender in which all of the rollers are mounted directly in support blocks that can move vertically along a stand. Most of the roller nips in the calender are bounded on one side by a hard roller and on the other side by a soft roller. A lifting apparatus, which acts on the support blocks of the lowest roller, has an operating position which is defined by contacting a fixed stop. The lowest roller can be lowered from the operating position into a separation position. A hydraulic cylinder acts on each of the support blocks of the uppermost roller so that forces exceeding the weight of the roller can be exerted on the roller stack, as is required for full calendering. Support elements, in the form of nuts, are adapted to move vertically on a pair of suspension spindles. In the separation position, the support elements maintain the rollers at a predetermined distance from one another. The support elements also support the support blocks of one or more of the uppermost rollers when these rollers are to be rendered inactive for light calendering. During light calendering, the inactive rollers are disposed so that a space is maintained between the inactive rollers, while the active lower rollers are disposed in an engaged position (i.e., in contact with one another).

Spacers are provided, which, when the rollers are separated, can be inserted between the side plate of one soft roller and the end region of an adjacent hard roller. Alternatively, the spacers can be inserted between the pistons of the lifting apparatus and their corresponding support surfaces on the support blocks of the lowest roller. The spacers are necessary so that the support elements, in the non-loaded state, can be moved to the height required for light calendering.

"Lever calenders" are used to prevent at least a portion of the rollers from being stressed by uncontrolled fictional forces, and to compensate for edge loads caused by overhanging weights. An example of a lever calender is disclosed in German Reference DE 43 14 670 A1, in which the bearing blocks of at least the middle rollers are supported by levers. The levers are mounted on a corresponding support block. The levers can pivot between an upper stop and a lower stop provided in the support block. The support blocks are supported on support elements, which are mounted on suspension spindles during normal calendering operation. To relieve the load applied to the support elements, positioning devices are disposed between the support elements and the bearing blocks. This lever calender can assume an operating position and a load-relief position, which is disposed at a lower height than the operating position. But light calendering can not be performed with lever calenders.

SUMMARY OF THE INVENTION

It is an object of the present invention to provide a calender that can perform both full and light calendering and which controls or minimizes the effect of friction forces.

This object is achieved with a calender that includes a stand. The stand has a mount. A suspension spindle is connected to the mount. A height of the suspension spindle is adjustable with respect to the stand. A guide is fixed to the stand.

A plurality of rollers are each connected to a support block. The rollers include an uppermost roller, a lowest roller, and at least one middle roller disposed between the uppermost and lowest rollers. Each of the support blocks is guided for movement along the guide. A plurality of support elements is connected to the suspension spindle. In a roller separation position, the support elements support a majority of the support blocks.

A lifting device is connected to the support block of the lowest roller. The lifting device moves the lowest roller between an operating position, in which the rollers are in contact with one another, and the roller separation position, in which the rollers are spaced apart from one another. An abutment is connected to the stand adjacent to the uppermost roller. A height of the abutment is adjustable with respect to the stand. A portion of the rollers are lifted so that they are spaced apart from one another to perform light calendering. The lifting device includes a device for supporting the support blocks of the portion of the rollers. The at least one middle roller is mounted on a bearing block. The bearing block is supported by a lever. The lever is pivotably mounted on the support block for the at least one middle roller. The lever pivots between an upper limit position and a lower limit position. The lifting device is movable by an overstroke from the operating position, through a relief position in which the support blocks are spaced from their respective support elements, into an overstroke position, in which the support blocks of a portion of the rollers are lifted to an inactive position.

The calender according to the present invention has at least the middle rollers being supported on the support blocks via levers. Consequently, the middle rollers are stressed only to a minimal extent by friction forces. Edge loads, such as those caused by overhanging weights, can be compensated for by using conventional load-relief devices disposed between the lever and the support block.

The lifting apparatus, inter alia, pushes the rollers into an overstroke position where the rollers are pushed against one another and are lifted above the operating position. The magnitude of the overstroke assures that the support elements will be relieved of any load, and also makes it possible to lift selected support elements far enough so that, during subsequent operation, one or more of the uppermost rollers are spaced apart from the rollers disposed immediately below, as is required for light calendering.

The overstroke is comprised of two segments, a load-relief stroke and an additional stroke. These segments can be traversed separately. Consequently, whenever only relief of the support elements is desired, only a comparatively slight lifting of the rollers is required.

After the height of the abutment has been adjusted, the position of the abutment in the stand is fixed. In other words, the upward movement of the support block for the uppermost roller is limited by the selectively adjustable position of the abutment. Consequently, the structure of the calender according to the present invention is quite simple because all adjustment and load functions are performed by the lifting apparatus. The operating position results when the support block of the uppermost roller contacts the abutment. When the position of the abutment is moved upward, the lifting apparatus can be lifted into the load-relief position and into the overstroke position.

The abutment is formed by an externally threaded pressure spindle so that it is relatively easy to adjust the height of the abutment.

The lifting device includes at least two fixed cylinders. A lifting piston is disposed within each cylinder. The cylinder includes a first stop, corresponding to the load-relief position, and a second stop corresponding to the overstroke position. The stops are formed by a stop piston disposed above the lifting piston in the cylinders. The stop piston moves by the additional stroke distance.

The mount and the support elements each include an internally threaded throughbore. The support elements are each selectively secured against rotation by a blocking device. The support elements have a predetermined height that is greater than or equal to the additional stroke distance.

The desired positions of the support elements can be achieved by rotating the suspension spindles and selectively blocking the rotation of the support nuts. Because of the sufficiently large height of the support elements, the blocking devices, which are mounted on the support block, are operational during the entire overstroke.

An abutment position sensor is used to detect when the abutment is disposed at a predetermined distance from the support block of the uppermost roller.

A plurality of position sensors are used to detect when the support blocks are disposed at a predetermined distance from the support elements.

A plurality of spindle position sensors are used to detect when the suspension spindle is disposed at a predetermined position relative to the stand. The plurality of spindle position sensors preferably comprise five spindle position sensors. A first one of the spindle position sensors detects a neutral position of the suspension spindle relative to the stand. A second one of the spindle position sensors detects a relatively minor degree of lowering of the suspension spindle corresponding to relieving a lead from the support elements. A third and a fourth one of the spindle position sensors detect a relatively greater degree of lowering corresponding to a roller replacement position. A fifth one of the spindle position sensors detects a lifting of the suspension spindle by a distance corresponding to the relief stroke.

The position sensors are used to automatically detect the displacements of the support elements, which is necessary when changing rollers and for light calendering.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
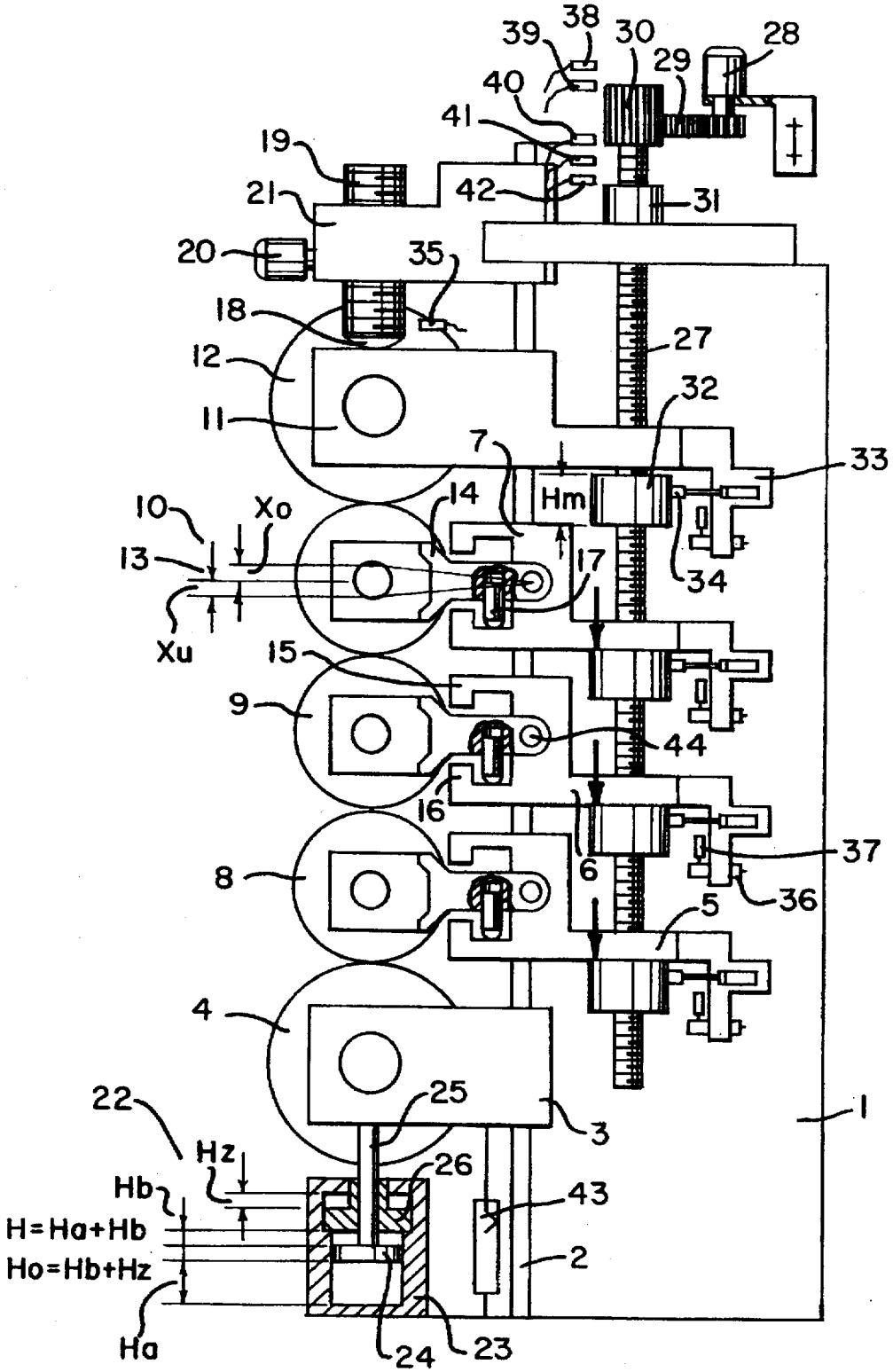
FIG. 1 shows a calender according to the present invention in an operating position for full calendering.

Referring now to FIG. 1, a calender is schematically illustrated. The calender includes an uppermost roller 12, a lowest roller 4 and middle rollers 8, 9 and 10 disposed between the uppermost roller and the lowest roller.

The calender includes a stand 1, which has a fixed vertical guide 2. A support block 3 for the lowest roller 4, support blocks 5, 6, and 7 for the middle rollers 8, 9, and 10, and a support block 11 for the uppermost roller 12 can all be moved along vertical guide 2. The lowest roller 4 and the uppermost roller 12 are mounted directly on support blocks 3, 11, respectively. But the middle rollers 8–10 are mounted on bearing blocks 13, which are supported by levers 14. Levers 14 are pivotably mounted on the respective support blocks 5, 6, and 7 by pivot links 44. A pivoting path $X_o$ of each lever 14 is bounded on top by a stop 15 disposed on the support block 5, 6, 7. A pivoting path $X_u$ of each lever 14 is bounded on the bottom by a stop 16 disposed on the support block. A load-relief device 17, formed by hydraulic cylinders, is disposed between lever 14 and the respective support block to compensate for edge forces.

A pressure spindle 19 is mounted within a housing 21. Housing 21 is fixed to stand 1. Spindle 19 has a threaded outer surface. Housing 21 has a throughbore that is threaded to mate with the threads on the spindle 19. An abutment 18 is disposed on a lower axial end of the pressure spindle 19. A motor 20 is operatively connected to spindle 19. Pressure spindle 19 can be moved up and down in housing 21 due to the actuation of reversible motor 20, which causes spindle 19 to rotate about its axis.

Figure 2:
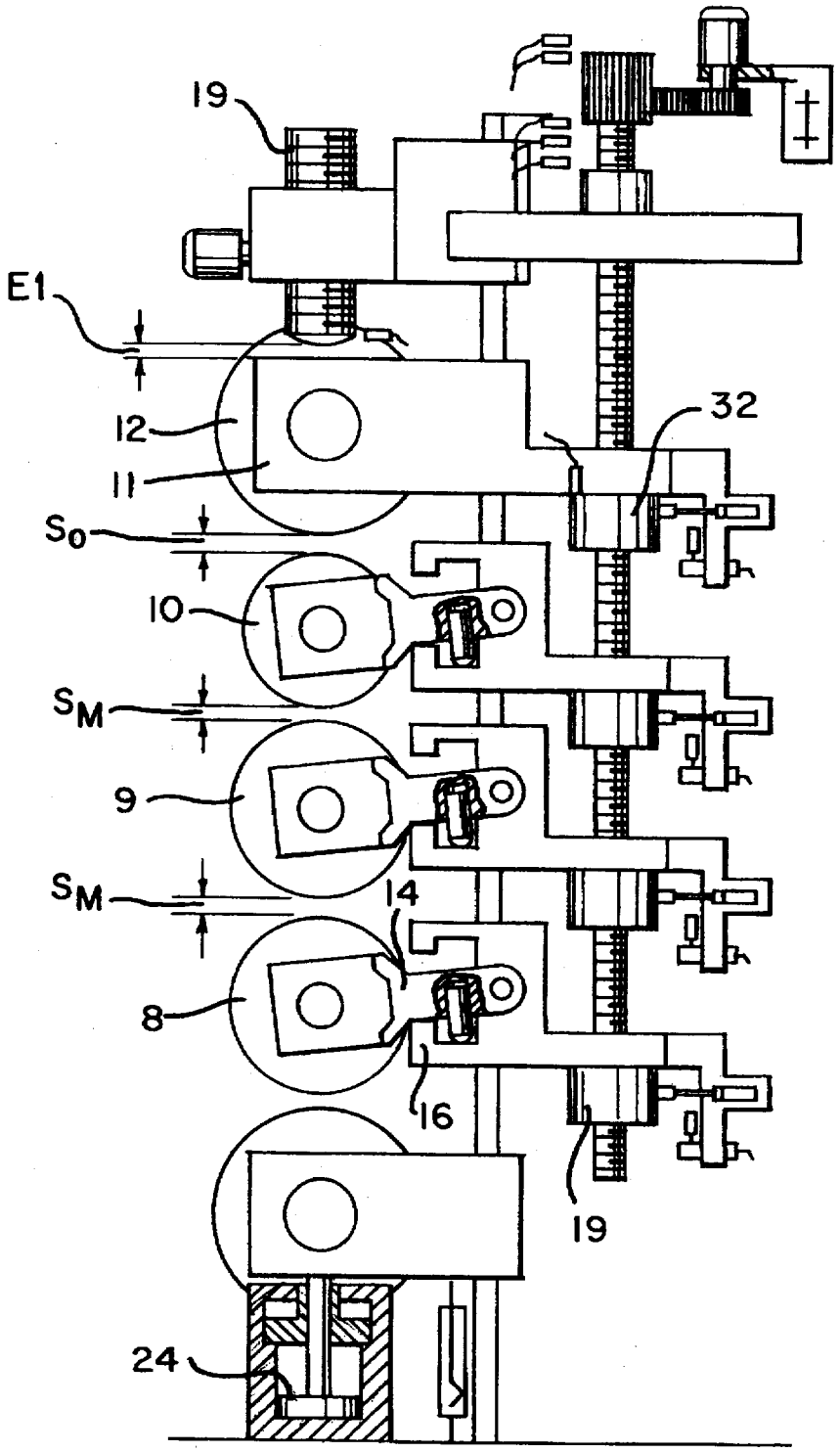
FIG. 2 shows the calender of FIG. 1, with the rollers in a separation position.
Figure 3:
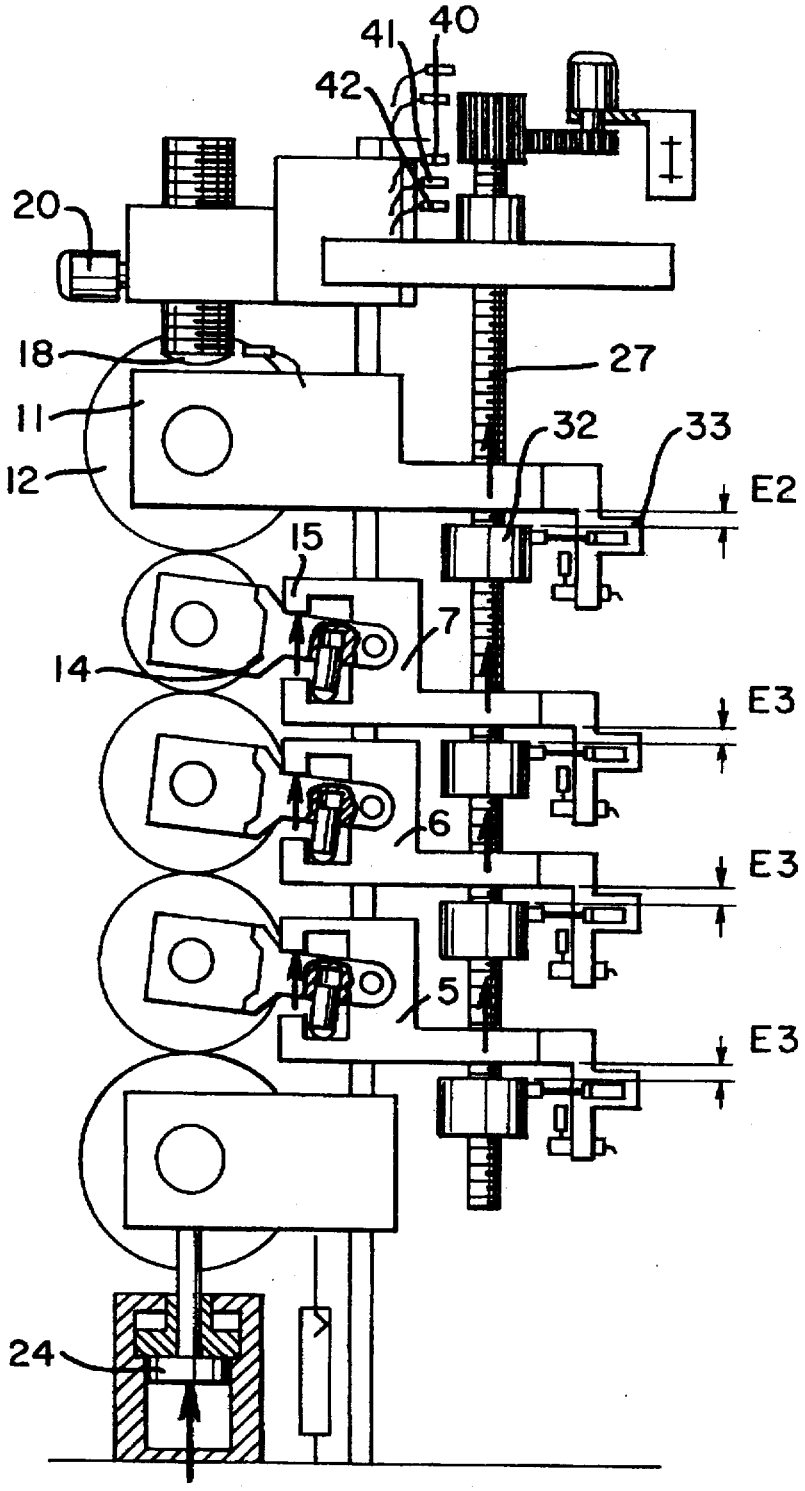
FIG. 3 shows the calender of FIG. 1, with the support elements in a load-relief position.
Figure 4:
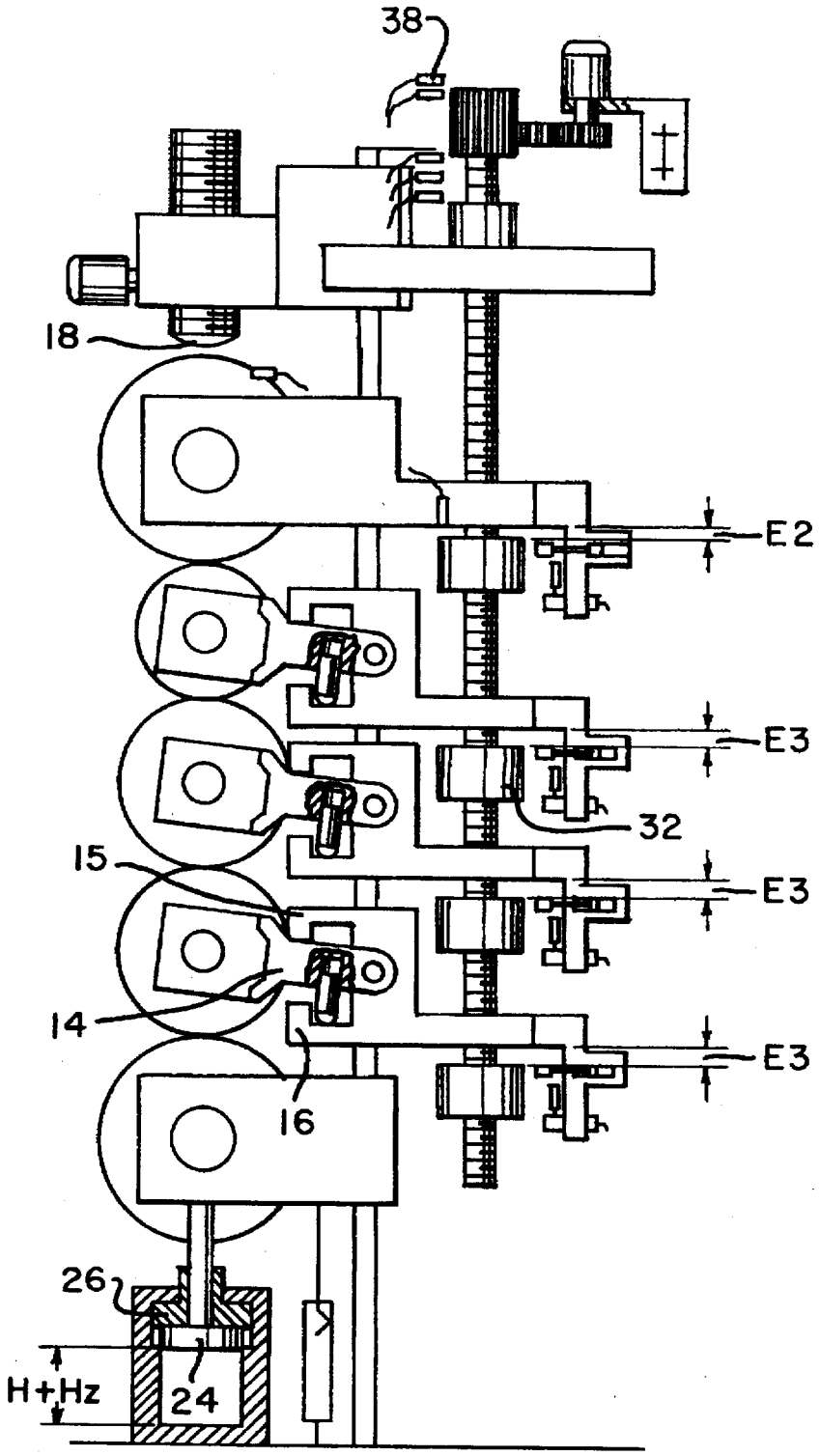
FIG. 4 shows the calender of FIG. 1 in an overstroke position.

A lifting apparatus 22 is disposed below the lowest roller 4. Lifting apparatus 22 includes a pair of cylinders 23 disposed on each side of the stand 1 (only one cylinder is shown). A reciprocating lifting piston 24 is disposed within each cylinder. One end of a piston rod 25 is connected to each piston 24. The other end of rod 25 is connected to the support block 3 for the lowest roller 4. A reciprocating stop piston 26 is disposed in each cylinder. Each stop piston 26 reciprocates between a lower limit position, as shown in FIG. 1, and an upper limit position, as shown in FIG. 4. Consequently, lifting piston 24 can be disposed in any one of the following four different positions:

1. An operating position is illustrated in FIG. 1. In the operating position, the lifting piston 24 is loaded from below so that the entire roller stack is pressed upward. Thus, support block 11 abuts against abutment 18;
2. A separation position is illustrated in FIG. 2. In this position, the lifting piston 24 assumes its lowest position by moving by a separation stroke distance Ha (with respect to the position illustrated in FIG. 1). In this position, all of the rollers are separated from one another;
3. A load-relief position is illustrated in FIG. 3. In this position, the lifting piston 24 is lifted by moving by a relief stroke distance Hb (with respect to the position illustrated in FIG. 1) until piston 24 contacts stop piston 26; and 4. An overstroke position is illustrated in FIG. 4. In this position, stop piston 26 is moved into its upper limit position. The lifting piston 24 is then moved up again by an additional stroke $H_z$ (with respect to the position illustrated in FIG. 3). Lifting piston 24 is now in contact with stop piston 26.

A suspension spindle 27, which has an external thread, can be rotated about its axis by a motor 28, via toothed wheels (i.e., gears) 29 and 30. Spindle 27 is held in a mount 31 that is fixed to stand 1. Mount 31 includes an internally threaded throughbore that mates with the external thread of spindle 27. In other words, mount 31 acts as a fixed nut. Consequently, as spindle 27 rotates, its vertical position changes with respect to stand 1. Each of the support blocks 5, 6, 7, and 11 has a corresponding support element 32. Each of the support elements 32 has an internally threaded throughbore and teeth disposed on its exterior surface. Each support element 32 can be fixed against rotation by a blocking device 33 that is held in the respective support block. Blocking device 33, by means of a latch 34, selectively engages the outer teeth of the support element 32. When engaged, relative displacement between the support element 32 and the suspension spindle 27 takes place. The height Hm of each of the support elements 32 is at least equal to the length of the additional stroke Hz plus the height of the latch 34 plus the length E2 and/or E3 (described below) so that an adjustment of the position of the support elements 32 can be made to perform light calendering.

A position sensor 35 responds when abutment 18 has reached a predetermined distance E1 from the support block 11 (see FIG. 2). Position sensors 36, disposed adjacent to the blocking devices 33, respond when the support elements 32 have reached a predetermined distance from the support blocks. Sensors 37 detect whether the blocking device 33 is active (i.e., engaged) or inactive (i.e., disengaged). Five position sensors 38, 39, 40, 41, and 42 interact with the toothed wheel 30 of the suspension spindle 27 to provide a signal to detect when the spindle has reached a predetermined height relative to stand 1. The position sensors may be, for example, inductive proximity switches, which emit a signal when covered by a metallic object (e.g., a support element 32). A measuring device 43 indicates the height of the lower roller 4 relative to the stand 1.

The total stroke H of lifting piston 24 within cylinder 23 is H=Ha+Hb. The overstroke Ho, which starts from the operating position of FIG. 1, is equal to Ho=Hb+Hz. The relief stroke Hb results from the defined lever path $X_0$ of the bearing blocks 13 of the middle rollers and the adjustment gap E3 between the support elements 32 and the support blocks 5, 6, and 7. The additional stroke Hz results from the defined lever path $X_u$ of the bearing blocks of the middle rollers 8, the relief stroke Hb, and a roller gap Sm. In one embodiment, the separation stroke Ha was 180 mm, the relief stroke Hb 18 mm, and the additional stroke Hz 60 min.

The calender according to the present invention operates as follows:

For full calendering (see FIG. 1), abutment 18 is disposed at a predetermined height, which depends on the diameters of the rollers. By loading the lifting piston 24 from below, the rollers can be loaded with an additional force, which exceeds the weight of the rollers. All of the rollers are in contact with one another.

If it is necessary to separate the rollers (see FIG. 2), for example, because the web of paper has torn, the lifting piston 24 is relieved of any load. The levers 14 of the middle rollers 8, 9, and 10 rest against the lower stops 16 of the support blocks. The support blocks are supported on their respective support elements 32. The support block 11 of the upper roller 12 falls until it is supported against its support element 32.

To replace the rollers, the support elements 32 must first be relieved of any load so that they may be moved to account for a change of roller diameter. The abutment 18 is first lifted by a sufficient amount by motor 20. The lift piston 24 is then moved into the load-relief position (See FIG. 3). When the lift piston 24 executes its upward motion, the rollers are moved together again until the levers 14 make contact with the upper stop 15 of the respective support blocks 5, 6, and 7. In this position, the support blocks, as well as the support block 11 of the uppermost roller 12, are lifted off of their respective support elements 32. The support elements 32 can now each be moved to the desired new height with the aid of the suspension spindle 27 and the blocking device 33. To automatically reposition the support elements, the suspension spindle 27 can be moved from its neutral position, determined by position sensor 40, into lower positions, determined by position sensors 41 and 42. As the spindle moves, the height of the support elements 32 can be selectively changed relative to the suspension spindle 27 by engaging the blocking device 33.

After all of the support elements 32 have been repositioned, the rollers are moved to the lowered, or separated, position of FIG. 2. The rollers may now be replaced. After the rollers have been changed, the pressure spindle 19 is moved such that an adjustment gap E1 is maintained between support block 11 and abutment 18. All of the middle rollers, as well as the uppermost roller, are lowered so that their respective support blocks rest on the support elements 32 (FIG. 2). Adjustment gap E1 corresponds to the gap E2 between the support block 11 and the uppermost support element 32, which occurs during normal operation. To adjust the adjustment gap E3 between the support blocks and the support elements 32, the rollers must be placed in the load-relief position of FIG. 3.

Figure 5:
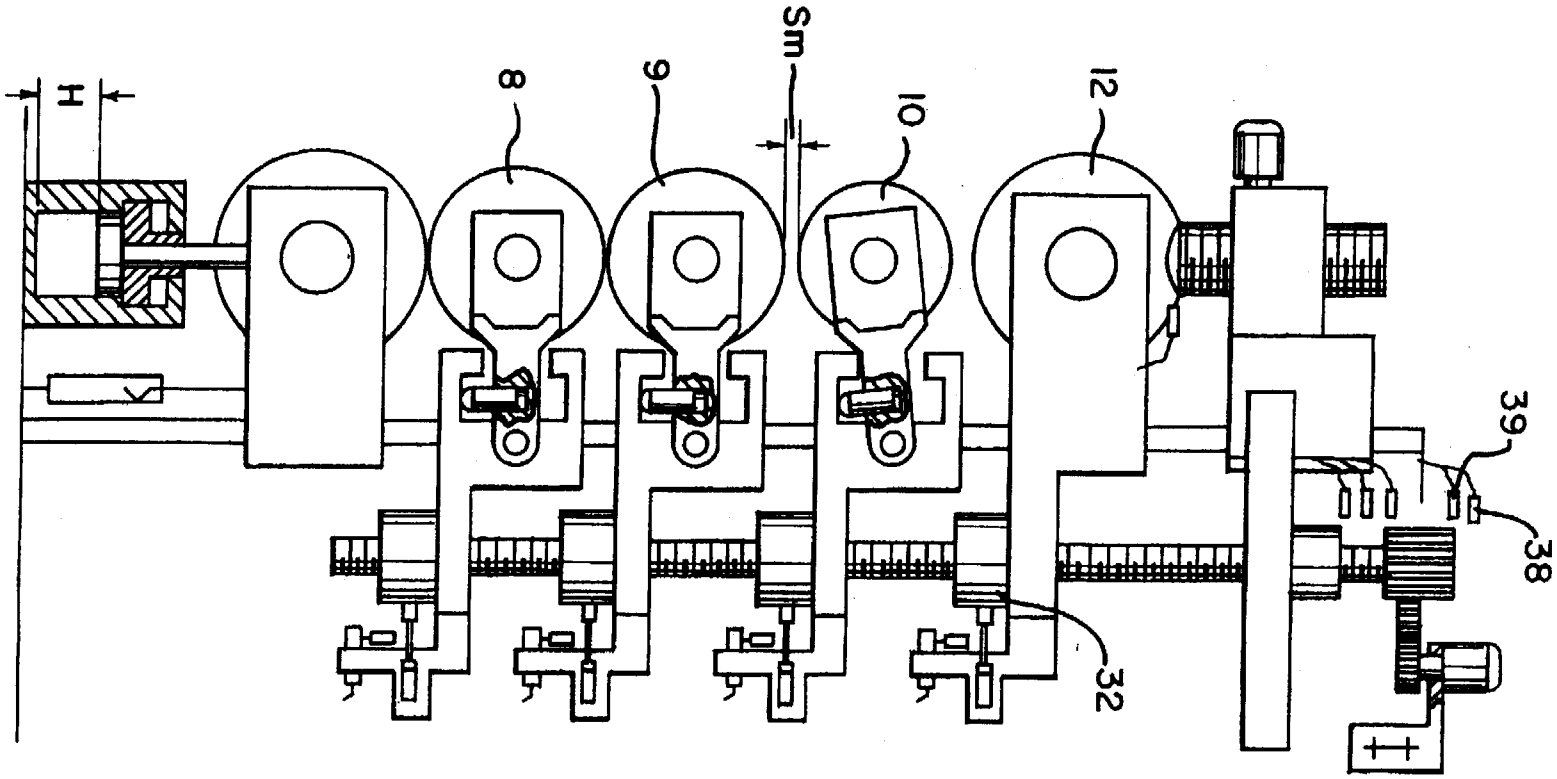
FIG. 5 shows the calender of FIG. 1 in an operating position for light calendering operation.

In the overstroke position of FIG. 4, abutment 18 is first moved to its uppermost position. Both the stop piston 26 and the lifting piston 24 are then moved upward by the additional stroke Hz. The support blocks are then all spaced by a predetermined distance from their respective support elements 32. This predetermined distance is increased by the additional stroke Hz with respect to the distance shown in FIG. 3. All of the support elements 32 are simultaneously moved upward by the amount of the relief stroke Hb with the aid of position sensor 38. Those support elements that are associated with the rollers that are not needed for light calendering are set to the distance E2 or E3 from their respective support blocks, while the support elements 32 lying below this retain their respective heights by employing blocking device 33. The lifting piston 24 is then lowered by the additional stroke Hz so that the support blocks of the unneeded rollers rest on their respective support elements 32 and their respective levers 14 are supported on the lower stops 16 of the bearing blocks. The support blocks of the rollers required for light calendering (i.e., those roller disposed below the unneeded rollers) are likewise supported on their respective support elements 32. But their associated levers 14 are positioned substantially horizontally between the upper stop 15 and the lower stop 16, as is also the case in the full calendering operating position of FIG. 1. The calender is now in position for light calendering as shown in FIG. 5. Only the three lower rollers are active, due to their weight, while the two upper rollers are held in an inactive position. The support elements 32 of the two upper rollers 10 and 12 have been moved a considerable distance upward, and the support elements 32 of the middle rollers 8 and 9 have been moved upward by a smaller distance. The position sensors 38 and 39 are used to control the appropriate positioning during this position adjustment of the support elements.

When the support elements 32 are displaced, as required, for example, for replacing the rollers, the latches 34 of the blocking device 33 engage the outer teeth of the support elements 32 at approximately the same height. However, the support elements 32 must have a sufficiently large height Hm so that the latches 34 can engage the outer teeth over the entire range of movement of the support elements.

Having described the presently preferred exemplary embodiment of the calender in accordance with the present invention, it is believed that other modifications, variations and changes will be suggested to those skilled in the art in view of the teachings set forth herein. For example, a stop for the relief position can be dispensed with if a normal replacement of the rollers is performed in the overstroke position of FIG. 4. Additionally, the suspension spindle 27 can have different shapes and/or structure. For example, the spindle 27 can be made from several parts or it can have motorized adjustable support nuts. Additionally, the height of the spindle could be adjusted by inserting spacers. The abutment could also be attached to a hydraulic cylinder. The lifting piston 24 could rest against an additional stop in its operating position. Stop 16 can also be formed by the end position of the piston of the load-relief device 17. It is, therefore, to be understood that all such modifications, variations, and changes are believed to fall within the scope of the present invention as defined by the appended claims.

We claim:

1. A calender for full and light calendering, said calender comprising:

a stand having a mount;

a suspension spindle being connected to said mount, a height of said suspension spindle being adjustable with respect to said stand;

a guide being fixed to said stand;

a plurality of rollers, said rollers including an uppermost roller, a lowest roller, and at least one middle roller disposed between said uppermost and lowest rollers, each of said plurality of rollers being connected to individual support blocks, each of said support blocks being guided for movement along said guide;

a plurality of support elements being connected to said suspension spindle, in a roller separation position said support elements supporting a majority of said support blocks;

a lifting device being connected to said support block of said lowest roller, said lifting device moving said lowest roller between an operating position, in which the rollers are in contact with one another, and said roller separation position, in which the rollers are spaced apart from one another;

an abutment being connected to said stand adjacent to said uppermost roller, a height of said abutment being adjustable with respect to said stand;

means for lifting a portion of said rollers so that they are spaced apart from one another for light calendering, said lifting means including means for supporting the support blocks of said portion of said rollers; and wherein said at least one middle roller is mounted on a bearing block, said bearing block is supported by a lever, said lever is pivotably mounted on the support block for said at least one middle roller, said lever pivoting between an upper limit position and a lower limit position, said lifting device being movable by an overstroke from said operating position through a relief position in which the support blocks are spaced from their respective support elements into an overstroke position, in which the support blocks of a potion of said rollers are lifted to an inactive position.

2. The calender of claim 1, wherein the overstroke comprises a relief stroke extending from the operating position to the relief position and of an additional stroke extending from the relief position to the overstroke position, each of said relief stroke and said additional stroke being separately traversable.

3. The calender of claim 2, wherein said lifting device includes at least two fixed cylinders, a lifting piston being disposed within each cylinder, each of said cylinders including a first stop corresponding to said relief position and a second stop corresponding to said overstroke position.

4. The calender of claim 3, wherein said stops are formed by a stop piston, said stop piston being disposed above said lifting piston, said stop piston being moveable by the additional stroke distance.

5. The calender of claim 2, wherein said mount includes an internally threaded throughbore, said support elements each includes an internally threaded throughbore, said support elements each being selectively secured against rotation by a blocking device, said support elements have a predetermined height that is greater than or equal to the additional stroke distance.

6. The calender of claim 2, further comprising a plurality of spindle position sensors to detect when said suspension spindle is disposed at a predetermined position relative to said stand.

7. The calender of claim 6, wherein said plurality of spindle position sensors comprise five spindle position sensors, a first one of said spindle position sensors detecting a neutral position of said suspension spindle relative to said stand, a second one of said spindle position sensors detecting a relatively minor degree of lowering of said suspension spindle corresponding to relieving a load from said support elements, a third and a fourth one of said spindle position sensors detecting a relatively greater degree of lowering corresponding to a roller replacement position, and a fifth one of said spindle position sensors detecting a lifting of said suspension spindle by a distance corresponding to said relief stroke.

8. The calender of claim 1, wherein the position of said abutment in said stand is fixed with respect to said stand after effecting an adjustment of said position.

9. The calender of claim 8, wherein said abutment is formed by an externally threaded pressure spindle whose height is adjustable.

10. The calender of claim 1, further comprising an abutment position sensor to detect when said abutment is disposed at a predetermined distance from said support block of the uppermost roller.

11. The calender of claim 1, further comprising a plurality of position sensors to detect when said support blocks are disposed at a predetermined distance from said support elements.

* * * * *